US005314061A

United States Patent [19]

Bedrossian

[11] Patent Number: 5,314,061

[45] Date of Patent: May 24, 1994

[54] PAINT BUCKET WITH INNER PAINT IMPLEMENT ATTACHING MEANS

[76] Inventor: Verelk Bedrossian, 4324 8e Rue, Chomedey, Laval, Quebec H7W 2A1, Canada

[21] Appl. No.: 63,664

[22] Filed: May 20, 1993

[51] Int. Cl.[5] ..... B65D 69/00

[52] U.S. Cl. ..... 206/229; 206/15.2; 206/15.3; 220/697; 220/735; 220/736

[58] Field of Search ..... 206/229, 15.2, 15.3; 220/697, 700, 735, 736, 521; 229/1.5 C

[56] References Cited

U.S. PATENT DOCUMENTS

| | | | |
|---|---|---|---|
| 2,738,900 | 3/1956 | Wenger | 220/735 |
| 3,032,177 | 5/1962 | Majors | 220/736 |
| 3,292,815 | 12/1966 | Smith et al. | 220/736 |
| 3,395,828 | 8/1968 | Schnabel | 220/697 |
| 4,533,044 | 8/1985 | Ban | 206/15.3 |
| 4,541,542 | 9/1985 | Florentino | 206/15.2 |
| 4,549,562 | 10/1985 | Ossi | 206/15.2 |
| 4,927,046 | 5/1990 | Armstrong | 220/736 |
| 5,074,098 | 12/1991 | Filipchuk | 206/229 |
| 5,139,139 | 8/1992 | Goetz | 206/229 |
| 5,178,274 | 1/1993 | Long | 220/697 |
| 5,201,439 | 4/1993 | Davies | 220/736 |

FOREIGN PATENT DOCUMENTS

| | | | |
|---|---|---|---|
| 175829 | 6/1935 | Fed. Rep. of Germany | 206/229 |
| 560757 | 4/1960 | France | 220/735 |
| 2547774 | 12/1984 | France | 206/229 |
| 8908590 | 9/1989 | PCT Int'l Appl. | 220/736 |

*Primary Examiner*—David T. Fidei

[57] ABSTRACT

A paint bucket comprised of an open-top-end container. A lid is engageable over the open-to-end. The lid is provided with attachment brackets on an inner surface thereof for the retention of one or more paint applicating implements. A slot is formed in a top end of the bucket for accommodating passage of a paint roller connecting rod whereby a wet paint roller may be held inside the container connecting rod and handle extending outside the container to maintain the wet roller in an enclosed area to prevent the wet roller from drying, when not in use.

7 Claims, 3 Drawing Sheets

PAINT BUCKET WITH INNER PAINT IMPLEMENT ATTACHING MEANS

BACKGROUND OF INVENTION

1. Field of the Invention

The present invention relates to a paint bucket comprised of an open-top-end container having a lid with attachment brackets disposed on a rear face of the lid to retain paint applicating implements thereagainst and wherein the paint bucket has a slot in a top edge thereof for the passage of a paint roller connecting rod whereby a wet roller may be stored inside the container to prevent drying thereof.

2. Description of Prior Art

It is known in the prior art to provide paint buckets having a ribbed wall surface formed with the bucket whereby to remove excess paint from a roll applicator brush rolled thereagainst. This is disclosed in U.S. Pat. No. 2,988,767. However, with such buckets there is a need to remove paint from the bucket in order to use the ribbed side wall as the paint in the bucket, when full, conceals this ribbed side wall. It is therefore necessary to have another bucket to store paint while the bucket with the flat ribbed wall is utilized. U.S. Pat. No. 2,983,938 also discloses a paint bucket wherein a roller-type paint applicator is inserted within the container, which is filled with paint, through a small cylindrical orifice and then withdrawn therefrom and during this withdrawing process a plurality of circumferential serrations will be in doctoring contact with the peripheral surface of the roller brush to remove excess paint. The purpose of this device is to eliminate the need to use paint pans which need to be constantly refilled due to their small capacity size. It also eliminates the need to clean the paint pan.

There is, however, another need for storing wet paint applicating implements, such as rollers or paint brushes, to prevent them from becoming dry when there is a pause in the applicating of paint for a substantial period of time. When wet paint implements are left uncleaned and exposed to air they dry out. This need to prevent wet paint implements from drying also eliminates the need to have to clean the paint implements each time there is a lengthy pause. Often paint implements have to be left wet for a substantial length of time.

There is a further need to provide a paint bucket which will also serve as a paint tray but without having to remove paint from within the bucket for access to a ribbed surface of the paint bucket whereby excess paint from a roller-type paint applicator can be removed.

SUMMARY OF INVENTION

It is a feature of the present invention to provide a paint bucket which overcomes the above mentioned disadvantages of the prior art and fulfills the required needs as stated hereinabove.

Another feature of the present invention is to provide a paint bucket which has a lid with attachment means on an inner surface of the lid for retaining one or more paint applicating implements.

Another feature of the present invention is to provide a paint bucket having a flat curved inner flat side wall portion with a plurality of spaced transverse ribs in a top portion thereof to remove excess paint from a roller-type paint applicating implement without the need of having to remove paint from the bucket for access to the ribbed wall.

Another feature of the present invention is to provide a paint bucket having a cover having retention means in an inner surface thereof and capable of retaining a wet paint applicating roller or brush within the container when the lid is closed to prevent the roller or brush from drying.

According to the above features, from a broad aspect, the present invention provides a paint bucket comprising an open-top-end container having a lid engageable over the top end of the container. Attachment means are provided on an inner surface of the lid for the retention of one or more paint applicating implements.

According to the above features, from another broad aspect, the present invention further provides a through slot in the top end of the bucket for accommodating passage of a paint roller connecting rod whereby to retain a wet roller within the container to prevent drying therefrom and with a portion of the connecting rod and handle of the roller extending through the through slot and disposed exteriorly of the container.

DESCRIPTION OF DRAWINGS

A preferred embodiment of present invention will now be described with reference to the accompanying drawings in which.

DESCRIPTION OF PREFERRED EMBODIMENTS

Figure 1:
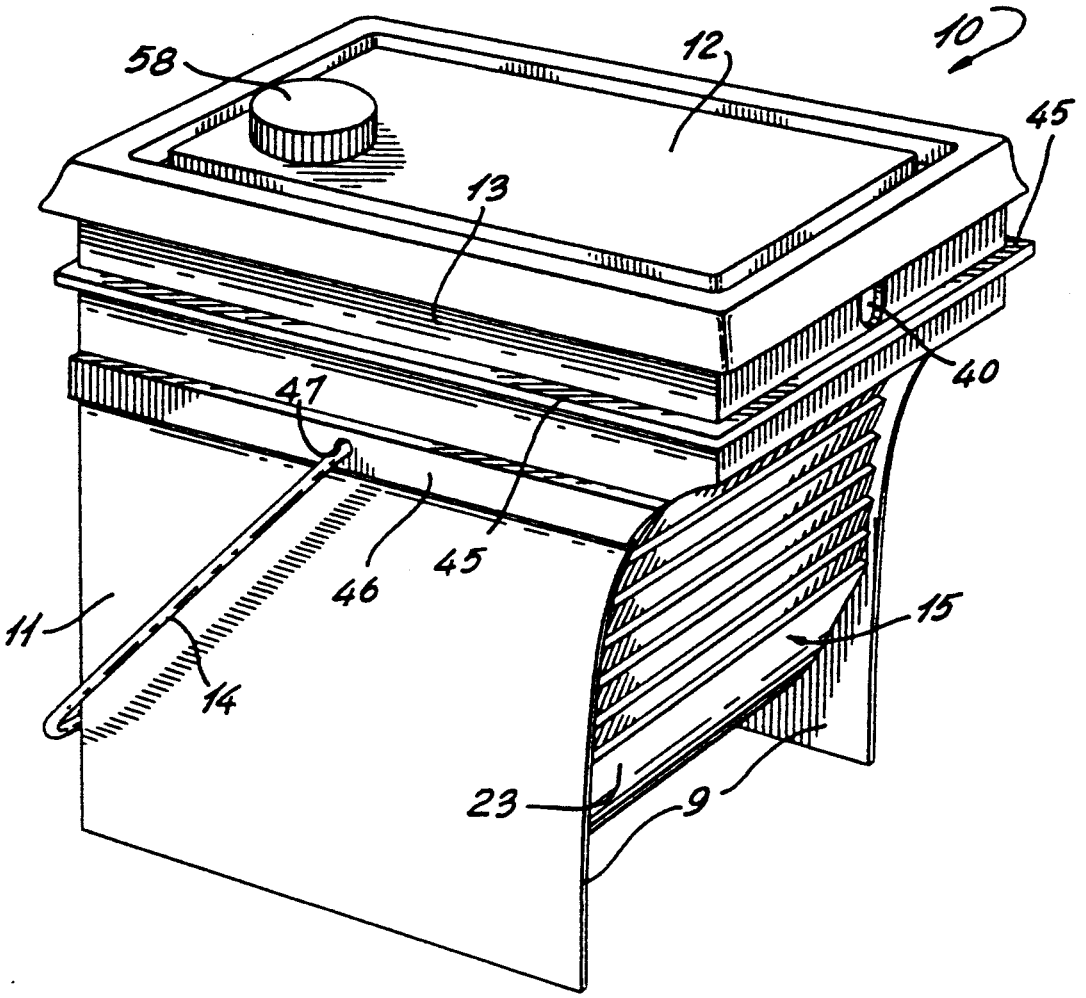
FIG. 1 is a perspective view of the paint bucket of present invention.
Figure 2:
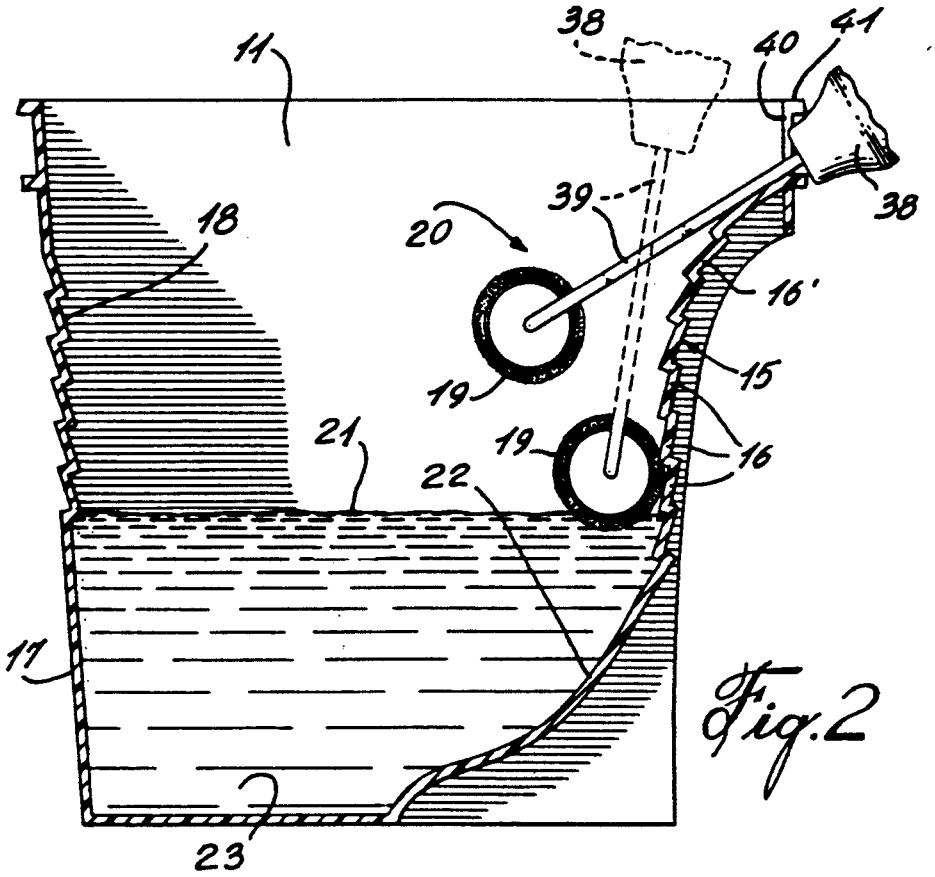
FIG. 2 is a transverse section view of the open-top-end container.

Referring now to the drawings and more particularly to FIGS. 1 and 2, there is shown the paint bucket 10 of the present invention and it comprises essentially an open-top-end container 11 of substantially rectangular or square cross section and having a lid 12 engageable over a top end 13 thereof. The container or bucket 11 is provided with a U-shaped bail 14 for transporting the bucket. As herein shown the rear side wall 15 of the bucket is curved and as shown in FIG. 2 is provided with a plurality of spaced-apart transverse ribs 16 in at least a top curved portion thereof.

As shown in FIG. 2 the opposed side wall 17 may also be provided with equidistantly spaced transverse ribs 18 in a top portion thereof for the same purpose as are the ribs 16 on the opposed curved side wall 15 and namely to remove excess paint from a paint roller-type applicator 20 by moving the roller 19 back and forth over these ribs, in a manner well known in the art. The rear curved side wall 15 has a specific shape which permits the paint bucket of present invention to be utilized with a substantial amount of paint inside the container 11 and this is achieved by having the top part of the side wall 15 curved outwardly such that the top ribs, herein ribs 16', are accessible close to the top of the container. These ribs 16' are in quantities would be sufficient to remove excess paint from the roller 19 when the container is filled to capacity to the level indicated at 21. The curved wall portion 22 below the ribbed portion 16 has a concave curve whereby to direct paint to the bottom area 23 when paint is removed by the transverse ribs. It also permits the roll 19 to be rolled thereon when picking up paint from the top level of the paint such as at 21', as it diminishes towards the bottom area 23 and also permitting substantial removal of all of the paint within the bucket. Accordingly, with the construction of this bucket there is no need to utilize conventional paint trays nor to transfer paint to other buckets.

Figure 3:
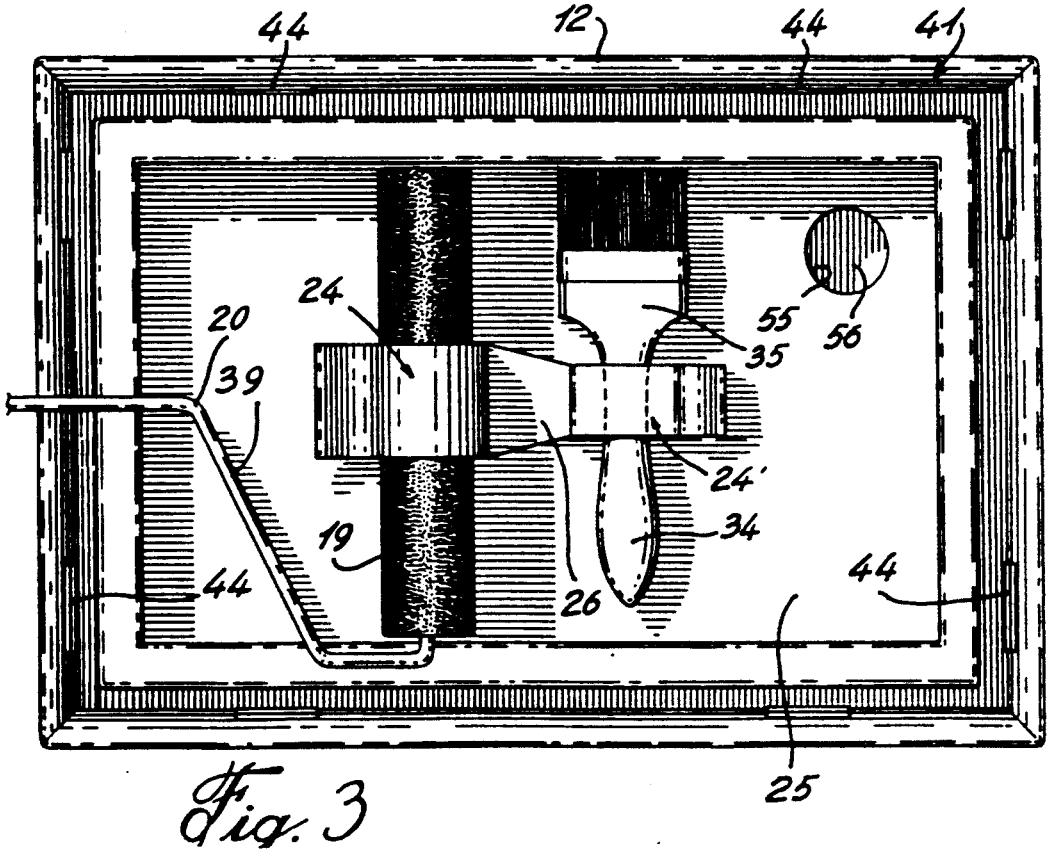
FIG. 3 is a plan view of the rear face of the lid.
Figure 4:
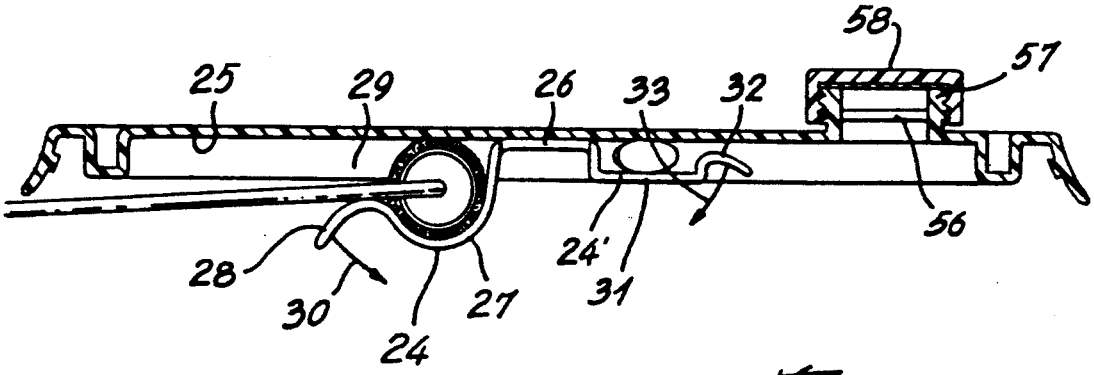
FIG. 4 is a cross-section view through the lid.

An important feature of present invention is illustrated in FIG. 3 and that is the provision of attachment brackets 24 and 24' within the inner surface 25 of the lid 12, as more clearly shown in FIG. 4. The bracket 24 is a clip-like bracket having a secured end 26 secured to the inner surface 25 of the lid 12, an arcuately shaped elevated intermediate portion 27 and an end lipped portion 28 held elevated from the inner surface 25. The shape of the attachment bracket 24 defines an open mouth 29 through which a paint applicator roll 19 can be introduced causing the bracket 24 to flex upwardly in the direction of arrow 30 and permitting entry of the roll 19 for clamping engagement under the arcuately shaped intermediate portion 27 for the retention thereof, as shown FIG. 3.

The paint brush retention bracket 24' consists of a flat retention wall, 31 closely spaced to the inner surface 25, and having a depending curved lip 32 at a free end thereof whereby to permit the bracket or clip 24' to be hinged outwardly in the direction of arrow 33 to permit the passage of the handle portion 34 of a paint brush 35 for clamping retention against the inner surface 25. Although in FIG. 3 there is shown a roller applicating device 20 secured with its roll 19 clamped by the bracket 24, it is pointed out that a spare roll 19 may be retained in the cover. The paint applicating device 20 may be suspended within the bucket, as illustrated FIG. 5, through the slot 40 with the cover closed. This will prevent the paint on the roll 19 from drying during short periods of time, for example a few days or a few weeks.

Figure 5:
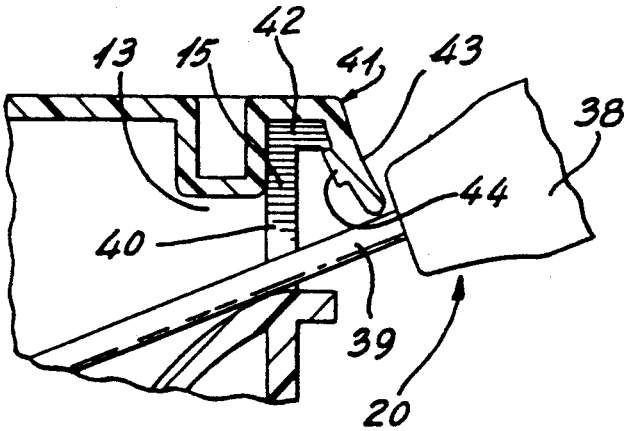
FIG. 5 is an enlarged view showing the connection of the lid with the open-top-end container and the through slot formed in a side wall of the lid.

As shown in FIGS. 1, 2 and 5 the slot 40 provided in the top edge 41 of the side wall 15 is for the passage of the connecting rod 39 of the roller applicator 20 with the handle 38 of the applicator disposed outwardly of the container. The slot 40 is dimensioned to permit close fit of the connecting rod 39 therethrough. As shown FIG. 5 the lid 12 is provided with a peripheral locking channel 41 which receives the peripheral ledge 42 of the container 11 therein in friction fit to substantially seal the top end 13 of the container 11. The locking channel 41 has a depending flange 43 which overlaps the ledge 42 and a top portion of the through slot 40. A plurality of tabs 44 are disposed about the locking channel 41 for snap retention with the peripheral ledge 42.

Referring again to FIG. 1 it can be seen that the side walls 9 of the container 11 are substantially rectangular and extend beyond the curved rear side wall 15 to provide proper support for the bucket 10. Furthermore, a peripheral ledge 45 extends about the container 11 and spaced from the open top end thereof to substantially arrest paint that may drip along the outer surface of the side walls when the container is in use. The ridge 45 and the wings 9 further add structural rigidity and support for the container. The container also has a structural ridge 46 extending in a top end thereof provided with holes 47 for the securement of the bail 14.

In use, the container 10 of the present invention may be sold with a roller-type paint applicating implement 20 secured to the inner surface of the lid 12 with the connecting rod 20 of the implement extending through the slot 40. Accordingly, the roll 19 is positioned above the paint level 21 in the container and is usually dry as long as the container is maintained upright. If the bucket is sold as such a rubber or foam seal (plug 50) can be positioned in the slot 40 over the connecting rod 39 of the roller applicator 20 to substantially seal the slot opening 40. When it is necessary to use the paint bucket, the lid is removed and the roller is detached. The roller is then dipped slightly against the paint level 21 and rolled against the uppermost rib 16' to remove excess paint therefrom. The excess paint drips back into the paint reservoir to the level 21. If it is necessary to stop painting there is a requirement to continue to paint after the pause, such as at the end of a day or during lunch breaks, the roller or the paint brushes 35 are clipped to the clamps 24 and 24' in the rear surface of the lid and the lid is positioned over the bucket. Accordingly, the wet paint applicating implements will not dry up, will not require cleaning or replacement and are ready for use again within a reasonable delay period.

Figure 6A:
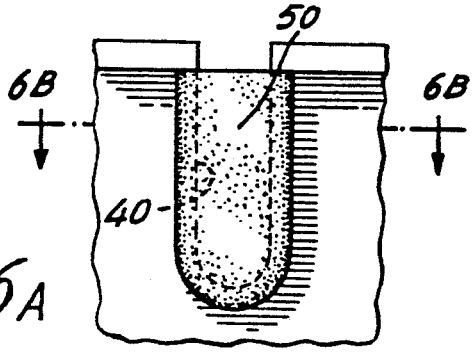
FIG. 6A is a plan view of a plug for closing the slot in the side wall of the container.
Figure 6B:
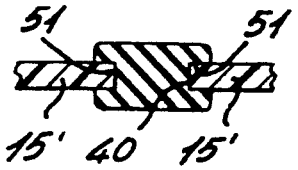
FIG. 6B is a cross-section view of FIG. 6A.

Referring to FIGS. 6A and 6B there is shown the construction of the sealing plug 50 formed of deformable rubber or foam plastic material whereby to seal the through slot 40 if it is necessary to store the container with paint whereby to seal the opening, whether a roll-type paint applicator is provided or not, to prevent outside air from entering the container. This plug 50 is U-shaped and provided with an intermediate U-shaped channel 51 for sliding fit within the side walls 15' on opposed sides of the slots 40 formed in the top edge of the rear wall of the container. The plug 50 can be placed over the rod 39 of the paint applicating device 20 to substantially obstruct the slot opening 40 during use.

As shown in FIGS. 1, 3 and 4, a hole 55 may be provided in the lid 12 and covered with a detachable sealing membrane 56. A threaded peripheral ridge 57 surrounds the hole 55 and extends on the top side of the lid. A screw cap 58 is threadably engaged with the ridge 57. The hole 55 permits the addition of color pigments in the paint within the container to provide a colored paint. A mixing implement is introduced through the hole 55 to mix the pigment in the paint base. This provides for mixing colors at the point of purchase and permits carrying low inventory by placing only a white base paint in the containers, as is well known in the art.

Various modifications of the embodiment of the paint bucket of the present invention are intended to be covered by the present applicating provided these modifications fall within the interpretation of any of the appended claims. As an example only the through slot 40 formed in the top edge of the rear side wall could also be conceivably be formed in an edge of lid only or both the lid and the side wall. However, it is preferable to have the slot formed in the top edge of the rear wall of the container.

I claim:

1. A paint bucket capable of holding one or more gallons of paint, said bucket comprising an open-top-end container, a lid engageable over said open-top-end, and attachment means on an inner surface of said lid for the retention of one or more paint applicating implement, said open-top-end container being a rectangular container having opposed parallel flat side walls, at least one said flat side wall having an uppermost side wall portion with a plurality of spaced transverse ribs projecting inwardly in said container to remove excess paint from a roller-type paint applicating implement, said side wall portion being an uppermost portion of one of said opposed side walls and being sloped outwardly of said one of said opposed side walls in a top portion thereof, a concavely curved lower section disposed below said uppermost portion and terminating in the direction of an opposed parallel side wall to said one of said opposed side walls, said curved lower section having a flat inner face and directing excess paint disposed between said ribs to a top surface of paint contained in said container, said lid having a peripheral side edge, said side edge having engaging means for sealing engagement with a contour edge of said open-top-end container, a through slot in a top edge of said bucket for accommodating passage of a paint roller connecting rod.

2. A paint bucket as claimed in claim 1 wherein said attachment means is a paint roller clamp for retaining a paint applicating roller against said inner surface of said lid.

3. A paint bucket as claimed in claim 2 wherein said attachment means further comprises a paint brush retention clamp for retaining a paint brush against said inner surface of said lid.

4. A paint bucket as claimed in claim 2 wherein said lid has a through hole therein, a threaded sleeve about said through hole, and a threaded cover threaded about said sleeve.

5. A paint bucket as claimed in claim 1 wherein said open-top-end container defines a flat rectangular bottom wall pan section between said opposed parallel side wall and a straight lower edge of said concavely curved lower section.

6. A paint bucket as claimed in claim 1 wherein said opposed parallel side wall is a straight vertical side wall, a plurality of spaced transverse ribs in a top portion of said opposed parallel side wall, said ribs projecting inwardly in said container to remove excess paint from a roller-type paint applicating implement displaced thereon.

7. A paint bucket as claimed in claim 1 wherein said transverse ribs terminate at opposed ends thereof spaced from opposed side edges of said at least one flat side wall portion, and ribs being of substantially pyramidal cross-section.

* * * * *